US007237402B2

(12) United States Patent
Hallin et al.

(10) Patent No.: US 7,237,402 B2
(45) Date of Patent: Jul. 3, 2007

(54) REFRIGERATOR AND METHOD

(75) Inventors: Anders Bengt Ingemar Hallin, Lidingö (SE); Per Wedby, Sundbyberg (SE)

(73) Assignee: Dometic Sweden AB, Solna (SE)

( * ) Notice: Subject to any disclaimer, the term of this patent is extended or adjusted under 35 U.S.C. 154(b) by 0 days.

(21) Appl. No.: 10/760,564

(22) Filed: Jan. 20, 2004

(65) Prior Publication Data

US 2005/0115268 A1 Jun. 2, 2005

(30) Foreign Application Priority Data

Dec. 1, 2003 (SE) ..... 0303234

(51) Int. Cl.
*F25D 17/04* (2006.01)

(52) U.S. Cl. ..... 62/407; 62/440; 62/151; 62/265

(58) Field of Classification Search ..... 62/151, 62/265, 268, 407, 440; 165/104.18
See application file for complete search history.

(56) References Cited

U.S. PATENT DOCUMENTS 2,616,272 A * 11/1952 McCloy ..... 62/275
2,781,641 A * 2/1957 Foley ..... 62/153
4,432,211 A 2/1984 Oishi et al.
5,339,644 A * 8/1994 Singh ..... 62/234
6,266,969 B1 7/2001 Malnati et al.
6,629,422 B2 * 10/2003 Wellman ..... 62/155

FOREIGN PATENT DOCUMENTS

| | | |
|---|---|---|
| DE | 1147 605 | 4/1963 |
| EP | 0 872 696 | 10/1998 |
| EP | 0 878 675 | 11/1998 |
| FR | 2 560 365 | 2/1984 |
| WO | 00/33004 | 6/2000 |
| WO | WO 03/008880 A1 | 1/2003 |

* cited by examiner

*Primary Examiner*—Melvin Jones
(74) *Attorney, Agent, or Firm*—Pearne & Gordon LLP

(57) ABSTRACT

Refrigerator comprising at least one compartment (2, 21) to be cooled and a refrigeration apparatus with an evaporator, which evaporator is arranged in heat conducting contact with a heat exchanger (6, 24, 50). The refrigerator further comprises an essentially enclosed chamber (7, 30, 40), in which chamber the heat exchanger (6, 24, 50) is arranged and which chamber communicates with the compartment (2, 21) through an inlet port (9, 31, 41) and an outlet port (10, 32, 42) of the chamber, for allowing air to circulate from the compartment through the inlet port into the chamber and trough the outlet port back to the compartment, and means (9, 11, 13, 31*a*, 31*b*, 41*a*, 41*b*, 42*a*, 42*b*) for preventing air to pass by self-circulation from the chamber, through the inlet port and/or outlet port. The invention also concerns a method for temperature control of a refrigerator.

13 Claims, 3 Drawing Sheets

REFRIGERATOR AND METHOD

FIELD OF THE INVENTION

The present invention relates to a refrigerator comprising at least one compartment to be cooled and a refrigeration apparatus with an evaporator, which evaporator is arranged in heat conducting contact with a heat exchanger.

The invention also concerns a method for controlling the temperature in a refrigerator.

BACKGROUND OF THE INVENTION

Modern refrigerators often comprise two or sometimes more compartments to be maintained at different temperatures. Normally, they comprise a freezer compartment for storing deep-frozen food at approx. −18° C. and a fresh food compartment for storing food at approx. +5° C. In the following, such compartments are referred to as freezer and fridge respectively. Sometimes, e.g. at larger household refrigerators, each compartment is cooled by a separate refrigeration apparatus. However, quite often a single refrigeration apparatus is utilized for cooling both the freezer and fridge. This is especially true for smaller household and mobile appliances such as at absorption refrigerators for recreation vehicles and mobile homes. At such refrigerators, the refrigerator apparatus comprises a condenser and an evaporator. Compressor refrigerators further comprise a compressor, whereas absorption refrigerators instead further comprise a boiler and an absorber. The evaporator comprises an evaporator tube for conducting a cooling medium. The evaporator tube is arranged so that it passes inside the compartments.

At absorption refrigerators, the evaporator reaches its lowest evaporation temperature at an uppermost, upstream end of the evaporator tube. Below and downstream and of the upstream end, the evaporation temperature rises gradually when the cooling medium in the tube absorbs heat from the air in the compartments. For this reason, the freezer is normally arranged to be cooled by an upstream portion of the evaporator tube, whereas the fridge is cooled by a tube portion being arranged downstream of the freezer tube portion.

At this type of refrigerators, the air to be cooled is normally circulated through self-circulation inside the respective compartments. Such self-circulation occurs due to a difference in density between cooler and warmer air. When air passes the evaporator, heat is transferred from the air to the cooling medium in the evaporator tube. The temperature of that air thus decreases, whereby its density increases. That recently cooled air thereby falls by influence of the gravity to the lower portion of the compartment. At the lower portion of the compartment and during its movement in the compartment, the air absorbs heat from the food stored in the compartment. When the cold air falls from the evaporator, a low pressure is created, whereby warmer air is drawn from the upper portion of the compartment to the evaporator. Thus the self-circulation in the compartment continues as long as the evaporator is kept at a lower temperature than other surfaces inside the compartment, such as the surfaces of the stored foodstuff.

For enhancing the heat transfer from the air in the compartments to the cooling medium, a heat exchanger may be arranged in heat conducting contact with a portion of the evaporator tube arranged in the respective compartment. The main function of the heat exchanger generally is to enlarge the surface area of the heat conducting material, which is in contact with the air to be cooled and the cooling medium in the evaporator tube. For this purpose the heat exchanger typically comprises a plurality of fins, which are arranged in heat conducting contact with the evaporator tube.

During normal operation of the refrigerator cabinet, humid air enters into the compartments e.g. when the cabinet doors are opened. As the humidity condenses on the cold surfaces inside the compartments, frost is created on these cold surfaces. Such development of frost is particularly severe on the coldest surfaces, i.e. on the evaporator tube and the heat exchanger in the freezer compartment. The formation of frost on the heat exchanger deteriorates the heat transfer from the air to the cooling medium and thereby lowers the cooling power of the compartment. If the refrigerator apparatus is not dimensioned to compensate for such loss in heat transfer, the temperature in the compartment rises, while jeopardizing the condition of the foodstuff stored in the compartment or the maximum possible storage time. In order to solve this problem, modern refrigerators may comprise means for defrosting the heat exchanger at regular intervals. In such case, the defrosting means is normally applied to the heat exchanger in the freezer, but it may also be applied in the fridge.

A major disadvantage with the above-described multi-compartment refrigerators, which utilize a single refrigeration apparatus, is that the temperatures in the different compartments cannot be controlled independently of each other. Since all compartments are cooled by the cooling medium in the same evaporator tube, it is not possible to regulate the evaporation temperature of the medium in the freezer portion of the evaporator without also influencing the evaporation temperature in the fridge portion and vice versa.

The evaporation temperature of the medium is normally controlled by running the refrigeration apparatus intermittently and regulating the length of the run and stop periods. In practice, a temperature-sensing device is arranged in one of the compartments, in which controlled compartment it is considered to be most important to keep the temperature within the preferred interval. Normally this is the fridge. The temperature sensor is connected to means for activating and deactivating the refrigeration apparatus. As soon as the temperature in the controlled compartment rises above a set value, the refrigeration apparatus is activated, whereby the evaporation temperature of the cooling medium is lowered. Thereby, the heat absorbing capability of the medium is increased and more heat is transferred from the air in the controlled compartment to the cooling medium in that portion of the evaporator, which is arranged in the controlled compartment. When the temperature in the controlled compartment has decreased to the desired value, or a value somewhat lower than that, the refrigeration apparatus is stopped. More or less sophisticated control algorithms may be utilized for calculating when to activate and de-activate the refrigeration apparatus in relation the actual temperature in the controlled compartment as well as other parameters, such as the time of the day, the ambient temperature etc. Further more, instead of being run intermittently, some refrigeration apparatuses may be controlled to run with varying cooling power in response to the actual temperature monitored by the sensor.

However, since also the non-controlled compartment is cooled by the same evaporator and refrigeration medium, the temperature in this compartment will vary in relation to the need for cooling the controlled compartment. If e.g. the refrigerator is used in a warm climate and the fridge door is frequently opened, there will be a great need for cooling the fridge and thereby the freezer will also be kept at a low temperature. If however the same refrigerator is used in a colder climate and the fridge is not so fully loaded or the fridge door not so frequently opened, then the freezer temperature will be higher. This phenomenon is naturally most unwanted and it is often perceived as a paradox by the user, concluding that there is something wrong with the refrigerator. The problem is especially articulate in mobile applications where the refrigerator may be used in varying climates.

A further disadvantage related to the above-described, is that it is not possible to run one of the compartments at a temperature other than what was intended by the manufacturer, while running the other compartment as intended. In other words, in a dual-compartment freezer-fridge combination it is not possible to run both compartments as fridges or freezers if that would be desired.

Another problem concerns defrosting of the evaporator and heat exchanger. And for that reason, defrosting of freezer compartments has up to now only been successfully applied to compressor refrigerators. In order to achieve defrosting of the heat exchanger, an electrical heater in the form a resistive film may be applied to the heat exchanger. The defrosting is activated at regular intervals and the refrigeration apparatus is then de-activated, while the resistive film is activated. The heat exchanger is then heated so that the frost formed thereon is melted. When defrosting is completed, the film is de-activated and the refrigeration apparatus re-activated.

A serious problem, which then occurs, is that also the air surrounding the heat exchanger is warmed up by the resistive film during defrosting. Such heating of air causes a reversed convection in the compartment, so that the heated air is distributed in the compartment by reversed self-circulation.

Thereby, a great amount of the heat generated for defrosting is instead used for heating the air in the compartment. This is naturally most unwanted since it reduces the efficiency of the defrosting and prolongs the time needed for defrosting the heat exchanger. Even more serious however, is that the circulation of heated air causes the entire compartment as well as the foodstuff stored therein to be warmed up. Bedsides that such warming up may deteriorate the quality of the foodstuff, it also increases the time and energy needed for bringing the temperature in the compartment back to the desired, after completion of the defrosting cycle.

This constitutes a particularly sever problem when trying to apply defrosting to freezers in absorption refrigerators. The comparatively low cooling capacity of absorption refrigeration apparatuses often makes it difficult to maintain the desired freezer temperature even without the additional heat added by the defrosting heater.

SUMMARY OF THE INVENTION

It is therefore an object of the present invention to provide a refrigerator and a method at which it is possible to control the temperature in two different compartments, which are cooled by the same refrigeration apparatus independently of each other.

It is a further object to provide a refrigerator at which defrosting can be effected in a compartment of the refrigerator with a minimum of excessive heating of the air in the compartment.

It is a still further object to provide a refrigerator at which heat exchanger defrosting can be applied at absorption refrigeration apparatuses.

These and other objects are achieved by a refrigerator according to the first paragraph of this description, which refrigerator comprises an essentially enclosed chamber, in which chamber the heat exchanger is arranged and which chamber communicates with the compartment through an inlet port and an outlet port of the chamber, for allowing air to circulate from the compartment through the inlet port into the chamber and trough the outlet port back to the compartment; and means for preventing air to pass by self-circulation from the chamber, through the inlet port and outlet port.

By preventing air to leave by self-circulation from the enclosed chamber to the compartment outside of the chamber, it is possible control the flow of air from the chamber to the compartment in which foodstuff is stored. By this means, air which is heated in the chamber during defrosting of the heat exchanger may be prevented from passing into the compartment by arranging the self-circulation prevention means to prevent relatively warmer air to pass out by self-circulation. Hereby, the above-mentioned problems related to heat convection during defrosting are drastically reduced.

It is also possible to arrange the self-circulation prevention means to prevent relatively cooler air, which has been cooled by the heat exchanger during normal operation, to pass out to the compartment by self-circulation. The flow of cool air may instead be controlled e.g. by a fan. Thereby, it is possible to regulate the temperature in the compartment independently of the temperature of the heat exchanger, just by controlling the flow of the fan. The refrigeration apparatus may thus be controlled in relation to the temperature in another compartment without affecting the temperature in the compartment, which is in fan-controlled communication with the chamber. Further more, it is also possible to arrange the self-circulation preventing means to prevent that both relatively warmer and relatively cooler air leaves the chamber by self-circulation. Hereby, both the advantages of efficient defrosting and independent temperature control are achieved.

The means for preventing self-circulation from the chamber may comprise a blocking section of the inlet and/or outlet ports of the chamber. The blocking section is arranged at a certain level in relation to the chamber. Due to being cooled during normal operation or heated during defrosting, the air in the chamber has a different temperature than the air outside the chamber. This difference in temperature leads to a corresponding difference in density, which tends to cause self-circulation of the air. The blocking section of the inlet and/or outlet port functions as a threshold, effectively preventing air to pass the level by self-circulation. For preventing heated air to pass the blocking section, this should be arranged at a low level in relation to the chamber and the defrosting heater inside it. For preventing cooled air to pass the blocking section, this should be arranged at high level in relation to the chamber and the heat exchanger.

The chamber enclosing the heat exchanger may be arranged inside the compartment, which is to be cooled by the heat exchanger. The chamber may however also be arranged in another compartment of refrigerator or even outside of the refrigerator cabinet. The compartment to be cooled by the heat exchanger inside the chamber is then connected for air circulation with the chamber through the inlet and outlet port.

Further objects and advantages of the refrigerator according to the invention are set out in the following detailed description and in the dependent claims.

The invention also relates to a method for controlling the temperature in a refrigerator compartment as set out in the independent claim 12.

DETAILED DESCRIPTION OF EMBODIMENTS

In the following, different exemplifying embodiments of the invention is described with reference to the drawings, where:

Figure 3A:
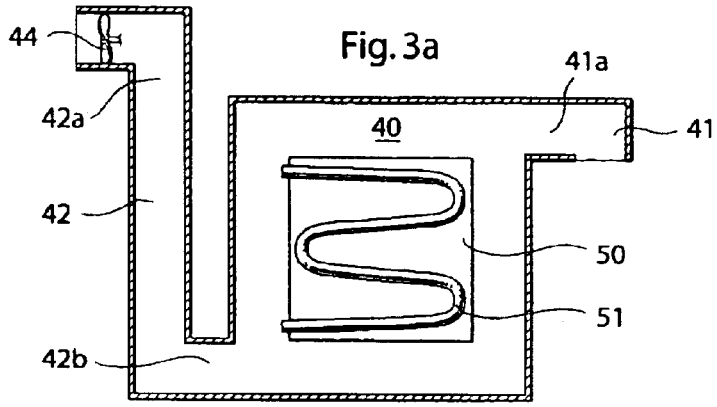
Figure 3B:
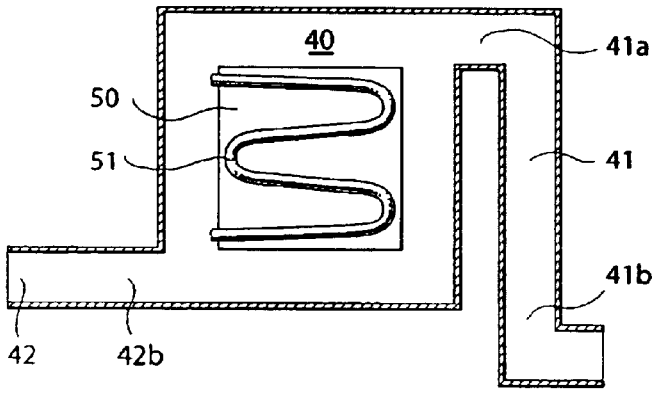
Figure 3C:
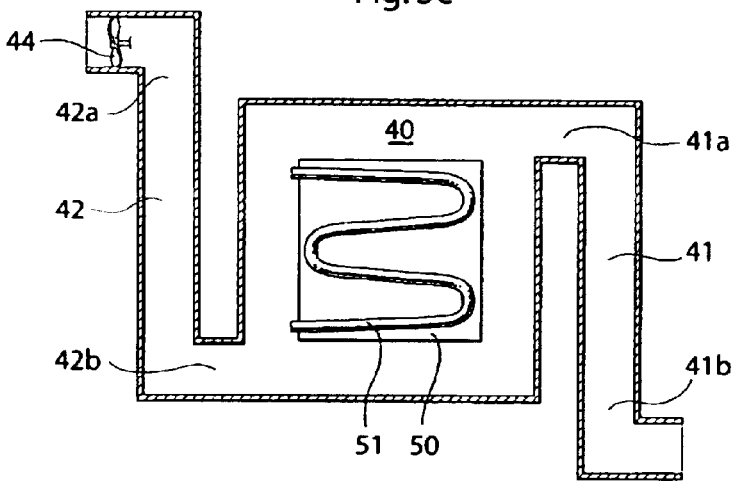

FIGS. 3*a*–3*c* are schematic drawings illustrating different principles of the invention.

Figure 1:
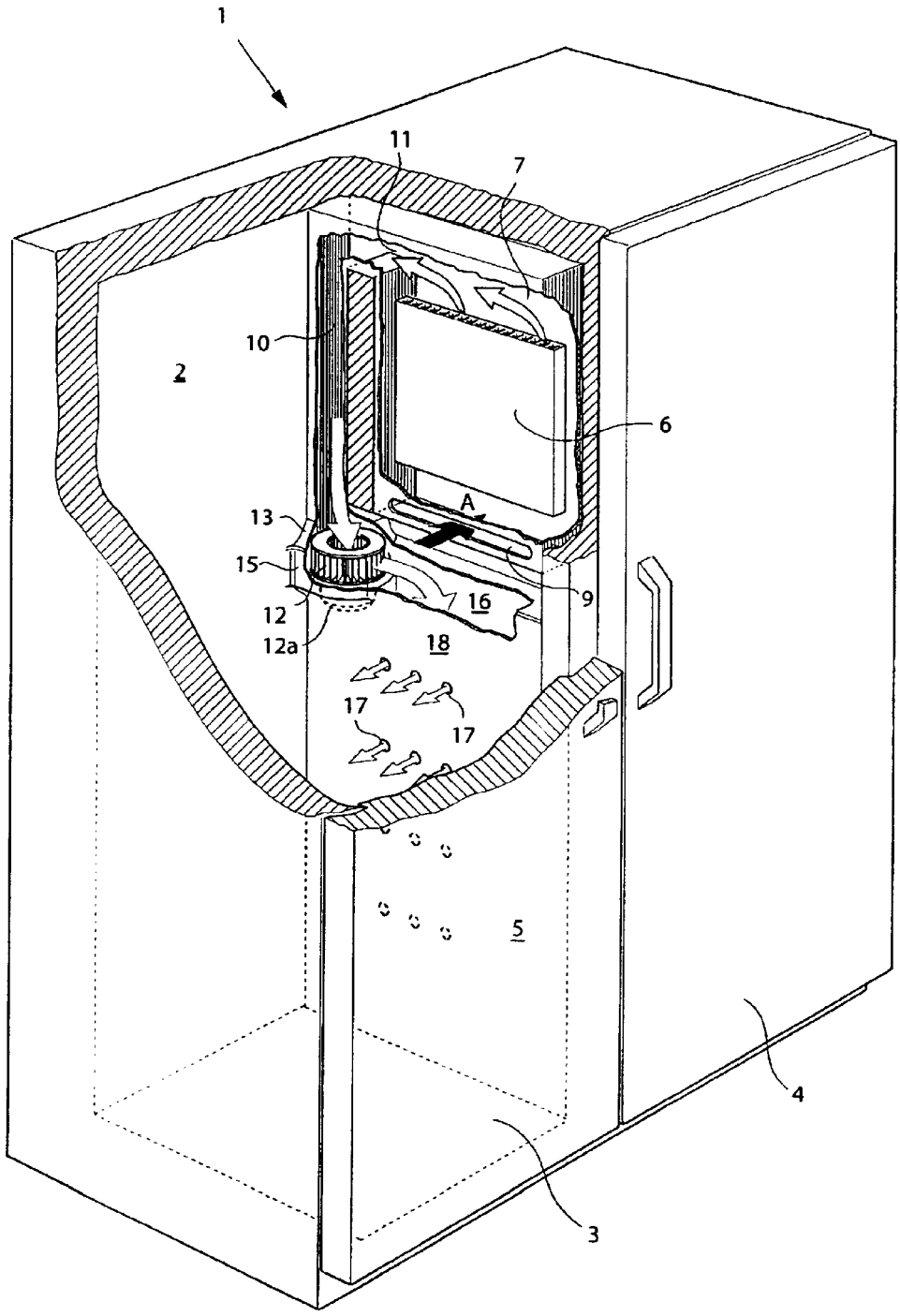
FIG. 1 is a perspective view with parts cut a way of a refrigerator according to a first embodiment of the invention.

FIG. 1 shows a so-called side-by-side absorption refrigerator 1. The refrigerator 1 comprises two compartments; a left hand freezer compartment 2 and a right-hand fresh food compartment or fridge. A dividing wall 5 separates the freezer 3 and the fridge from each other. The freezer 2 and fridge are enclosed by top, bottom and sidewalls. Access to the compartments is made possible by a freezer front door 3 and a fridge front door 4.

Both compartments are cooled by one and the same refrigeration apparatus (not shown). The refrigeration apparatus comprises a boiler, an absorber, a condenser and an evaporator. The evaporator comprises an evaporator tube for carrying a coolant medium. The evaporator tube has an upstream end arranged in the upper left portion of the dividing wall as seen in FIG. 1. From the upstream end, the evaporator tube extends downward inside the dividing wall, exhibiting a number of tube bends at the upper half of the dividing wall. The tube bends form a freezer portion of the evaporator for absorbing heat from the freezer. A heat exchanger 6 is attached to the freezer portion of the evaporator tube. Downstream of the freezer portion the evaporator tube exits the dividing wall on the fridge side and extends on the inside of the rear wall of the fridge compartment. Here the evaporator tube also exhibits a number of tube bends, which form a fridge portion of the evaporator. A fridge heat exchanger is attached to the fridge portion of the evaporator tube. Downstream of the fridge portion, the evaporator tube exits the fridge compartment through the rear wall and is connected to the absorber of the refrigerator apparatus. A temperature sensor is arranged inside the fridge compartment and connected to the refrigeration apparatus to activate and de-activate this in relation to the temperature in the fridge.

As illustrated in FIG. 1, the freezer heat exchanger 6 is arranged inside an essentially enclosed chamber 7. The chamber 7 is formed inside the dividing wall 5 and is defined by top, bottom and sidewalls, which form part of the dividing wall. An inlet port 9 of the chamber is arranged as a horizontally elongated slot through the wall of the chamber facing the freezer compartment. The inlet port is arranged through a lower portion of the chamber wall, below the lowest point of the heat exchanger and just above the bottom wall of the chamber 6. An outlet port 10 is arranged at the rear side of the chamber. The outlet port 10 forms a duct having the general shape of an inverted L. At the upper end of the inverted L the outlet port 10 is connected to the upper portion of the rear wall of the chamber. This connection 11 is arranged above the upper portion of the heat exchanger 6. At its lower end the outlet port leads into a fan housing 15. A connection 13 between the outlet port 10 and the fan housing 15 is arranged at a level, which is below the heat exchanger and the bottom wall of the chamber. A centrifugal fan 12 is arranged inside the fan housing 12. The centrifugal fan is powered by a variable speed electrical motor 12*a*. The fan housing 15 comprises a discharge port, which leads to an air-distributing duct 16, which extends inside the dividing wall 5 essentially from just below the chamber downwards to the bottom of the freezer compartment 2. The air-distributing duct 16 extends over essentially the full depth of the freezer compartment. A number of air distributing apertures 17 are arranged in a thin wall member 18 of the dividing wall, which wall member 18 separates the air-distributing duct 16 from the freezer compartment 2.

The heat exchanger 6 comprises a fin package, which is formed by an extruded aluminum member. The fin package is comprised of two base plates, which are arranged in parallel to each other and to the general extension plane of the dividing wall 5 and the chamber 7. Between the base plates, a number of fins are arranged perpendicular to the base plates, so that they form vertical airflow channels through the fin package. An electrical heater (not shown) in the form of a thin resistive film is arranged on the side surface of the fin package, which faces towards the freezer compartment. The resistive film is arranged for defrosting the heat exchanger and the evaporator portion, which is arranged in direct contact with and in the proximity of the heat exchanger.

During normal operation of the refrigerator, the refrigerator apparatus is activated for supplying the evaporator tube with cooling medium. The cooling medium circulates in the evaporator tube, thereby absorbing heat from the air in the freezer and in the fridge through heat transfer through the respective heat exchangers arranged in the freezer and fridge.

During such normal operation the electrical motor 12*a* is energized to power the centrifugal fan 12. The fan draws relatively warm air from the freezer compartment through the inlet port 9 (arrow A) and into the chamber 7. Here the air is drawn further upwards along and through the heat exchanger 6 whereby heat from the air is transferred by the heat exchanger to the cooling medium in the freezer portion of the evaporator tube. The so cooled air is further drawn through the outlet port connection 11 and the outlet port 10 to the fan housing 12, from where it is discharged into the air-distributing duct 16 and distributed by the apertures 17 into the lower portion of the freezer.

In the embodiment shown in FIG. 1, the centrifugal fan may be utilized to regulate the temperature in the freezer compartment, to a certain extent. If for instance, if the fridge is not loaded with a lot of foodstuff and if the fridge door is closed for a longer period of time, the temperature in the fridge will be maintained at the desired level without activating the refrigeration apparatus very often. This will lead to an increase of the evaporation temperature in the freezer portion of the evaporator. Thereby, the ability of the of the freezer portion of the evaporator to absorb heat from the freezer air is reduced, which might lead to an undesired increase of the freezer temperature. In such case however, the centrifugal fan 12 can be controlled to increase the flow of air drawn through the chamber. Thereby, increasing the cooling effect in the freezer, which compensates for the higher evaporation temperature of the cooling medium and reduces the freezer temperature to the desired.

The embodiment shown in FIG. 1 cannot however in an effective manner compensate for the reversed condition. It might happen that the temperature sensor in the fridge controls the refrigeration apparatus to be constantly activated and thereby to provide cooling medium at a lower temperature than what is needed for keeping the freezer at the desired temperature. Stopping the fan cannot then completely block the air-circulation through the chamber and the freezer compartment. Since the inlet port 9 is arranged below the heat exchanger, air cooled by the heat exchanger will fall by the influence of gravity and thereby create a reverse self-circulation.

However, the main advantage of the embodiment illustrated in FIG. 1 concern the defrosting cycle. During defrosting of the heat exchanger 6, the refrigeration apparatus and the fan 12 are deactivated. The resistive film on the heat exchanger 6 is activated. The heat exchanger is thereby heated for melting any frost, which is formed on the heat exchanger. During this process it is inevitable that also the air surrounding the heat exchanger 6 is heated to a certain degree. According to the invention however, the so heated air is enclosed in the chamber 7. Further more, the inlet port 9 is arranged below the heat exchanger 6, which heat exchanger carries the heating means. Therefore and since the heated air has a lower density than the air outside of the inlet port 9, the heated air is prevented from passing out through the inlet port 9. The heated air instead rises within the chamber and is trapped at the upper portion of the chamber 7 and the outlet port 10. A portion of the heated air may be forced down a certain distance in the outlet port, but since the outlet port 10 extends down to the connection 13, which is arranged below the lowest portion of the heat generating film and the chamber, the principle of communicating vessels prevents heated air from passing down below a certain level. By arranging a portion of the outlet port, which portion forms a blocking section, below the lowest portion of the chamber 7 self-circulation of heated air through the outlet port is effectively prevented.

Figure 2:
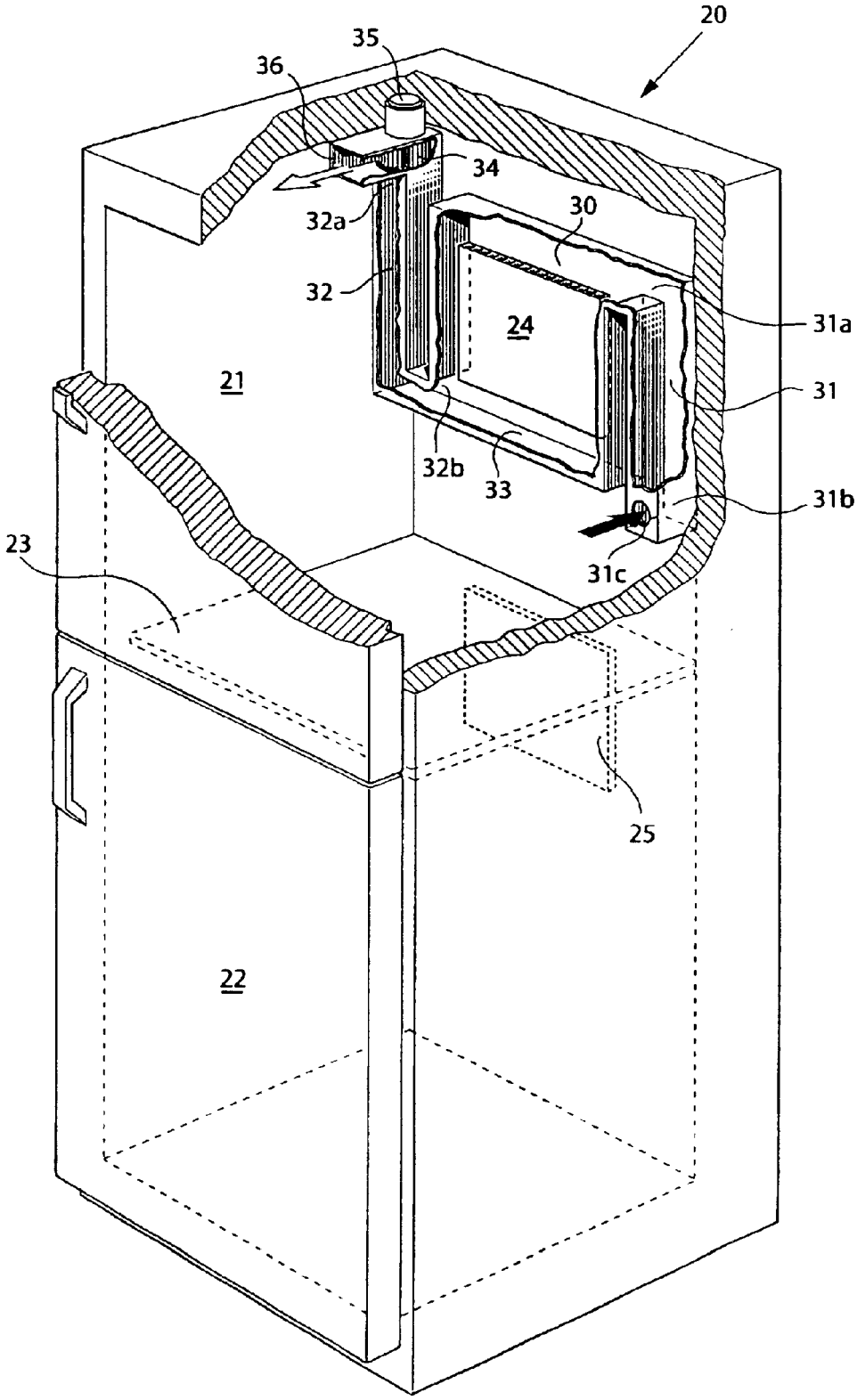
FIG. 2 is a perspective view with parts cut away of a refrigerator according to second embodiment of the invention.

FIG. 2 illustrates a refrigerator according to a second embodiment of the invention. This refrigerator 20 comprises an upper compartment 21 and a lower compartment 22. The two compartments are separated by a horizontal dividing wall 23. A first heat exchanger 24 is arranged inside the upper compartment 21 and in heat conducting contact with an upstream portion of an evaporator tube (not shown). A second heat exchanger 25 is arranged in the lower compartment 22 and in heat conducting contact with a downstream portion of the same evaporator tube.

The first heat exchanger 24 is provided with a defrosting resistive film (not shown). The first heat exchanger 24 is further enclosed in a chamber 30, which is arranged inside the upper compartment 21. The inside of the chamber 30 communicates with the compartment through an inlet port 31 and an outlet port 32. The inlet port 31 is formed as an inverted L and exhibits an upper blocking section 31*a*, which connects to the inside of the chamber at an upper portion thereof, above the heat exchanger 24. The inlet port 31 further exhibits a lower blocking section 31*b*, which is arranged below the heat exchanger 24 and a bottom wall 33 of the chamber 30. An inlet opening 31*c* is arranged just below the lower blocking section 31*b*.

The outlet port 32 correspondingly comprises a lower blocking section 32*b* connecting the rest of the outlet port 32 to the inside of the chamber 30. The uppermost portion of this connecting blocking section 32*b* is arranged below the heat exchanger 24. The outlet port 32 also comprises an upper blocking section 32*a*, which is arranged above the heat exchanger 24 and the chamber 30. Above the upper blocking section 32*b*, a variable speed centrifugal fan 34 is arranged for drawing air from the compartment 21, through the inlet opening 31*c*, the inlet port 31 the chamber 30, the outlet port 32 and discharging the air to the same compartment 21 through an outlet opening 36. The fan 34 is powered by a variable speed electrical motor 35.

With this embodiment of the invention it is possible both to limit the heat transfer in the upper compartment during defrosting and to regulate the temperature in the upper compartment independently of the temperature in the lower compartment.

During normal operation, the refrigeration apparatus is regulated in response to a temperature sensor (not shown), which is arranged in the lower compartment 22. Thereby, the evaporation temperature of the cooling medium in the upstream portion of the evaporator tube varies in relation to the actual need of the lower compartment 22 to be cooled. However, these variations in evaporation temperature can be compensated for to a great extent by the arrangement according to the invention. If the evaporation temperature of the upstream portion of the evaporator tube is higher than normal, the fan 34 may be driven at an increased speed, thereby increasing the airflow through the chamber and the heat exchanger. By this means the total cooling effect of the arrangement in the upper compartment 21 is increased and the temperature in this compartment 21 may be lowered to the desired.

If on the other hand, the lower compartment causes the evaporation temperature to decrease below the normal, the speed of the fan 34 is reduced or alternatively the fan is completely stopped. If the later is needed, the circulation through the chamber is essentially stopped. At such an instance the heat exchanger 24 still cools the air inside the chamber 30. Since the temperature of the air, which has passed the heat exchanger inside the chamber, is lower than the temperature of the air outside the chamber, the air inside the chamber 30 also has a grater density. Due to the upper blocking section 32*a* being arranged at a certain vertical level in relation to the chamber 30 and the cool heat exchanger 24 surface, a balancing system is formed. The balance prevents cold air to pass through the outlet port to thereby cause self-circulation through the upper compartment 21 and the chamber 30.

It can be shown that, as long as the blocking section 32*a* of the outlet port 32 is arranged at a vertical level, where the center of gravity of the air column, below the blocking section in the outlet port 32 is higher than the vertical level of the center of gravity of the air inside the chamber, the system is balanced and self circulation through the outlet port 32 is prevented. Naturally, the vertical level of the blocking section 32*a* needed for preventing passage of air, varies in relation to the temperature difference between the air inside and outside the chamber. However, in practice it has been noted that arranging the outlet port 32 so that it extends to a vertical level which is above the highest point of the chamber 30 is sufficient for all practical applications of the invention. Even arranging a blocking section 32*a* of the outlet port 32 above the vertical level of the top of the cold surface of the heat exchanger has proven to be sufficient for most applications.

During normal operation when the heat exchanger 24 is cold, no air leaves through the inlet port 31, since the cold air in the chamber then would have to pass above the upper blocking section 31*a*, which is arranged above the top of the heat exchanger 24.

During defrosting, the refrigerator apparatus and the fan 34 are de-activated, while the defrosting film is heated. The temperature of the air in the chamber 30 thus exceeds the temperature of the air outside the chamber, whereby the density of the air inside the chamber is lower than the density of the air outside. Hereby, a balance, which is analogous but reversed in regard of the direction of gravity to the balance described above, is effected. Analogous to what is said above, it has shown that arranging a blocking section 31*b* of the inlet port 31 below the lowest part of the chamber 30 or even the heat exchanger 24 is sufficient in most practical applications for achieving a satisfying prevention of self-circulation of air out from the chamber 30 through the inlet port 31.

In FIGS. 3*a*–*3b* three basic principal embodiments are schematically illustrated. All embodiments include a chamber 40, which encloses a heat exchanger 50, which is in heat conducting contact with a portion 51 of an evaporator tube. In all three embodiments the air flows from the right to the left (as seen in the figures) during normal operation.

At the embodiment shown in FIG. 3*a* the inlet port 41 is provided with an upper blocking section 41*a*. The outlet port 42 is provided with an upper blocking section 42*a* and a lower blocking section 42*b*. A fan 44 is required for circulating air during normal operation. This embodiment may be useful in e.g. dual-compartment refrigerators, where it might be needed to control the temperature of a compartment in which the chamber is arranged or a remote compartment, independently of the temperature in a second compartment which is cooled by the same refrigeration apparatus. This embodiment is however not useful for preventing heated air to spread in the surrounding compartment, since there is no lower blocking section provided for preventing warm air to pass out through the inlet port 41.

At the embodiment shown in FIG. 3*b*, the inlet port 41 is provided with an upper blocking section 41*a* and a lower blocking section 41*b*. The outlet port 42 is provided only with a lower blocking section 42*b*. No fan is provided since during normal operation, cooled air is allowed exit through the outlet port to self-circulate. This embodiment is thus effective in preventing heated air to spread in a surrounding or connected compartment. It cannot be used for independent temperature control of to compartments served by a single refrigeration apparatus.

At the embodiment shown in FIG. 3*c* both the inlet port 41 and the outlet port 42 are provided with upper blocking sections 41*a*, 42*a* as well as lower blocking sections 41*b*, 42*b*. A fan 44 is needed for effecting circulation. This embodiment is thus useful both for achieving independent temperature control and to prevent heated air to spread during the defrost cycle.

The refrigerator and method according to the inventive concept of effectively preventing air to leave the chamber by self-circulation may be advantageously used in various applications. For instance, the independent temperature control achieved may be applied at dual-compartment refrigerators for alternately and independently of each other utilizing the compartments either as a freezer or fridge or even chiller or wine storage compartment. Further more, the concept may be applied for regulating the temperature of a compartment, which is remotely positioned in relation to the chamber enclosing the heat exchanger. In such case, the remote compartment to be cooled and temperature-controlled, should communicate only with the chamber enclosing the heat exchanger, through the inlet and outlet ports.

When the invention is used for effecting independent temperature control, it is important that the chamber containing the heat exchanger is insulated from the compartment with which the chamber communicates. Otherwise, heat can be transferred from the compartment to the chamber and the heat exchanger by heat conduction through the wall separating the chamber from the compartment. Thereby, the possibility to control the temperature in the compartment by regulating the airflow could be drastically reduced. If the chamber is positioned in a first compartment and communicating with a second remote compartment for temperature control of this second compartment, it is also important that the inside of the chamber is heat insulated from the first compartment.

It should be noted that the present invention provides a simple and efficient means for preventing self-circulation and achieving temperature control by flow regulation. No dampers, draught valves, slide valves or similar movable arrangements are needed. The only movable part needed for achieving temperature control with the arrangement according to the invention is a fan. Fans require little maintenance, they are durable, reliable, easy to install, and above all, easy to control. This in combination with the simplicity of the means for preventing self-circulation according to the invention allows for a simple, cost effective and reliable refrigerator providing temperature control by flow regulation.

Another important advantage with the present invention is that it provides a very effective and simple means for preventing defrosting heat to spread in the refrigerator, not requiring any movable parts at all. The invention makes it possible to apply defrost heating to absorption refrigerators, and to achieve defrosting of the fridge as well as the freezer and any other compartment of such an absorption refrigerator.

In this application heat exchanger means any kind heat transferring means, which transfers heat from the air to the cooling medium inside the evaporator tube. The heat exchanger may include flanges, fins, baffles, wool or a single heat conducting plate arranged in heat conducting contact with the evaporator tube. The heat exchanger may be arranged in direct contact with the tube, but it may also be connected thereto by heat transferring intermediate arrangements. The heat exchanger may however also be constituted by the evaporator tube itself or a portion thereof.

What is claimed is:

1. Refrigerator comprising at least one compartment to be cooled and a refrigeration apparatus with an evaporator, which evaporator is arranged in heat conducting contact with a heat exchanger, characterized by an essentially enclosed chamber, in which chamber the heat exchanger is arranged and which chamber communicates with the compartment through an inlet port and an outlet port of the chamber, for allowing air to circulate from the compartment through the inlet port into the chamber and trough the outlet port back to the compartment, and means for preventing air to pass by self-circulation from the chamber, through the inlet port and/or outlet port.

2. Refrigerator according to claim 1, wherein the means for preventing self-circulation from the chamber comprise a section of the inlet port and/or the outlet port, which section is arranged at a certain vertical level in relation to the chamber, which level is chosen not to allow air to pass from the chamber through said section by self-circulation caused by a difference in density of the gas inside and outside the chamber.

3. Refrigerator according to claim 2, wherein a section of the inlet and/or outlet port is arranged in level with or above an upper portion of the chamber.

4. Refrigerator according to claim 2 or 3, wherein a section of the inlet and/or outlet port is arranged in level with or below a lower portion of the chamber.

5. Refrigerator according to any of claims 1, wherein said chamber is arranged inside the compartment.

6. Refrigerator according claim 1, wherein said chamber communicates with a first compartment through the inlet and outlet ports and is arranged inside a second compartment, which is arranged essentially not to communicate with the first compartment.

7. Refrigerator according to claim 1, wherein heating means are provided for defrosting said heat exchanger.

8. Refrigerator according to claim 1, wherein a fan is provided for forced circulation of air from the compartment through the inlet port into the chamber and trough the outlet port back to the compartment.

9. Refrigerator according to claim 8, wherein the fan is arranged for controlling the forced circulation flow and thereby regulating the temperature in the compartment.

10. Refrigerator according to claim 9, wherein the fan is a variable speed fan and means are provided for controlling the speed of the fan in relation to the temperature in the compartment.

11. Refrigerator according to claim 1, wherein the chamber is heat insulated from a compartment in which compartment the chamber is positioned.

12. Method for controlling the temperature in a refrigerator, which refrigerator comprises a refrigeration apparatus, a first compartment with a first heat exchanger and a second compartment with a second heat exchanger, the first and second heat exchanger being arranged to transfer heat from the respective compartment to the refrigeration apparatus characterized in that the temperature in the first compartment is controlled by regulating the refrigerating effect of the refrigeration apparatus and that the temperature in the second compartment is controlled by regulating the air circulation flow in the second compartment.

13. Method according to claim 11, wherein the air flow in the second compartment is conducted from the second compartment through an inlet port of a chamber and through an outlet port of the chamber back to the second compartment and; wherein the air flow is forced by a fan to pass a section of the inlet port and/or outlet port, which section is arranged at a certain vertical level in relation to the chamber for preventing self-circulation of air from the chamber through the section to the second compartment.

* * * * *

UNITED STATES PATENT AND TRADEMARK OFFICE

CERTIFICATE OF CORRECTION

PATENT NO. : 7,237,402 B2
APPLICATION NO. : 10/760564
DATED : July 3, 2007
INVENTOR(S) : Anders Bengt Ingemar Hallin and Per Wedby It is certified that error appears in the above-identified patent and that said Letters Patent is hereby corrected as shown below:

On the Title Page Item 57:
In the Abstract: Line 11 - Delete the word “trough”; replace with the word --through--;

In the Specifications:
Column 2, line 54: Insert the word --to-- after the word “relation” and before the word “the”;

Column 3, line 44: Delete the word “Bedsides”; replace with the word --Besides--;

Column 3, line 48: Delete the word “sever”; replace with the word --severe--;

Column 4, line 8: Delete the word “trough”; replace with the word --through--;

Column 4, line 14: Insert the word --to-- after the word “possible” and before the word “control”;

Column 6, line 54: Remove the third set of words “of the”;

Column 8, line 28: Delete the word “later”; replace with the word --latter--;

Column 8, line 35: Delete the word “grater” replace with the word --greater--;

Column 9, line 40: Delete the word “to”; replace with the word --two--;

In the Claims:
Column 10, line 50: Delete the word “trough”; replace with the word --through--;

Column 11, line 3: Insert the word --to-- after the word “according” and before the word “claim”;

UNITED STATES PATENT AND TRADEMARK OFFICE

CERTIFICATE OF CORRECTION

PATENT NO. : 7,237,402 B2
APPLICATION NO. : 10/760564
DATED : July 3, 2007
INVENTOR(S) : Anders Bengt Ingemar Hallin and Per Wedby It is certified that error appears in the above-identified patent and that said Letters Patent is hereby corrected as shown below:

Column 11, line 12: Delete the word "trough"; replace with the word --through--

Signed and Sealed this

Eighteenth Day of September, 2007

JON W. DUDAS
*Director of the United States Patent and Trademark Office*